US007491092B2

(12) United States Patent
Zhu et al.

(10) Patent No.: US 7,491,092 B2
(45) Date of Patent: Feb. 17, 2009

(54) CARD EDGE CONNECTOR WITH DURABLE KEY

(75) Inventors: Jian-Kuang Zhu, Kunshan (CN); Wan-Qin Ji, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/150,573

(22) Filed: Apr. 29, 2008

(65) Prior Publication Data

US 2008/0207058 A1 Aug. 28, 2008

Related U.S. Application Data

(62) Division of application No. 11/656,058, filed on Jan. 22, 2007, now Pat. No. 7,364,467.

(51) Int. Cl.
*H01R 24/00* (2006.01)

(52) U.S. Cl. ..... 439/633; 439/680; 439/681

(58) Field of Classification Search ..... 439/630, 439/633, 674, 677, 680, 681
See application file for complete search history.

(56) References Cited

U.S. PATENT DOCUMENTS 6,159,052 A * 12/2000 Meng et al. ..... 439/633

* cited by examiner

*Primary Examiner*—Tho D Ta
*Assistant Examiner*—Travis Chambers
(74) *Attorney, Agent, or Firm*—Wei Te Chung

(57) ABSTRACT

An electrical connector (100) include an insulating housing, one row of contact disposed in the housing, a key (6) and a position member (67). The housing defines an elongated slot (12) extending longitudinally along a first direction while communicating with an exterior in a second direction perpendicular to the first direction. The key is inserted into the slot in the second direction and the position member encounters the key in a third direction to prevent the key from fall off in the second direction.

14 Claims, 11 Drawing Sheets

CARD EDGE CONNECTOR WITH DURABLE KEY

CROSS-REFERENCE OF RELATED APPLICATION

The instant application is a Division of a mother U.S. patent application entitled "CARD EDGE CONNECTOR WITH DURABLE KEY" filed on Jan. 22, 2007, Ser. No. 11/656,058, now U.S. Pat. No. 7,364,467, which is assigned to the same assignee with this application.

BACKGROUND OF THE INVENTION

1. Field of the Invention

The present invention relates to a card edge connector, and more particularly to a card connector for receiving a daughter card.

2. Description of the Related Art

A card edge connector usually includes an elongated insulating housing defining an elongated slot for receiving a card, and a plurality of contacts received along two opposite inner walls of the slot. A key is positioned in the slot, and is integrally formed with the housing. The card is inserted into the slot with its notch nicely aligning with the key.

The key is made from the same material that the housing is made from, which is usually plastic or resin material. During continual insertion/removal of the card, the key might become thin or be broken, which will result in non-precise-position-function to the card.

Hence, an improved card edge connector is desired to overcome above problems.

BRIEF SUMMARY OF THE INVENTION

It is an object of the present invention to provide a card edge connector with a durable key capable of preventing from abrasion or breakage.

It is another object of the present invention to provide a card edge connector nicely positioning a card received therein.

In order to obtain the objective above, an electrical connector comprises an insulating housing, one row of contact disposed in the housing, a key and a position member. The housing defines an elongated slot extending longitudinally along a first direction while communicating with an exterior in a second direction perpendicular to the first direction. The key is inserted into the slot in the second direction and the position member encounters the key in a third direction to prevent the key from falling off in the second direction.

Other objects, advantages and novel features of the invention will become more apparent from the following detailed description of the present embodiment when taken in conjunction with the accompanying drawings.

DETAILED DESCRIPTION OF THE INVENTION

The present invention discloses a card edge connector receiving a daughter card and five embodiments are given in detail hereinafter.

Figure 1:
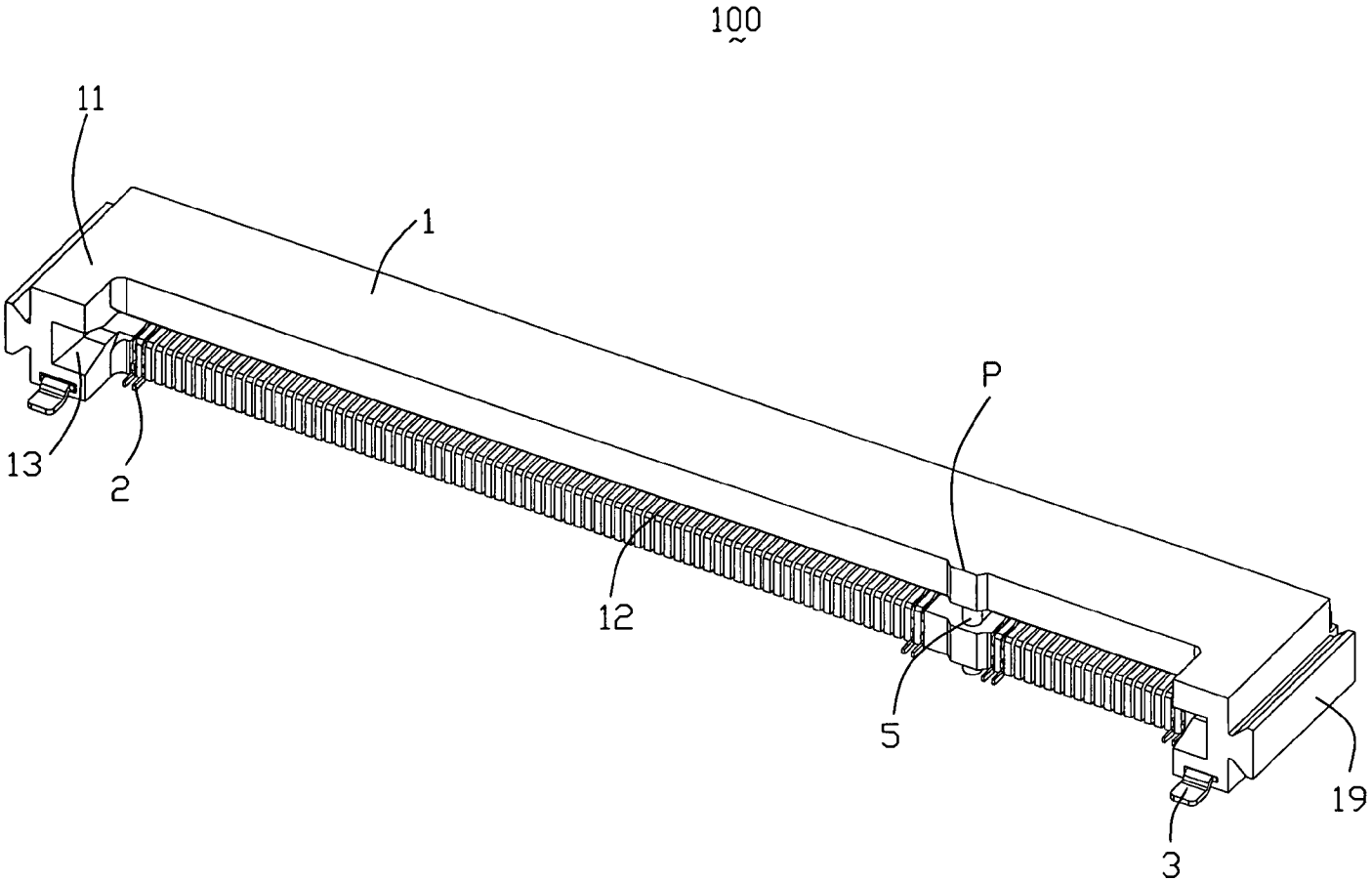
FIG. 1 is a front side perspective view of a card edge connector according to a first embodiment of the present invention.
Figure 2:
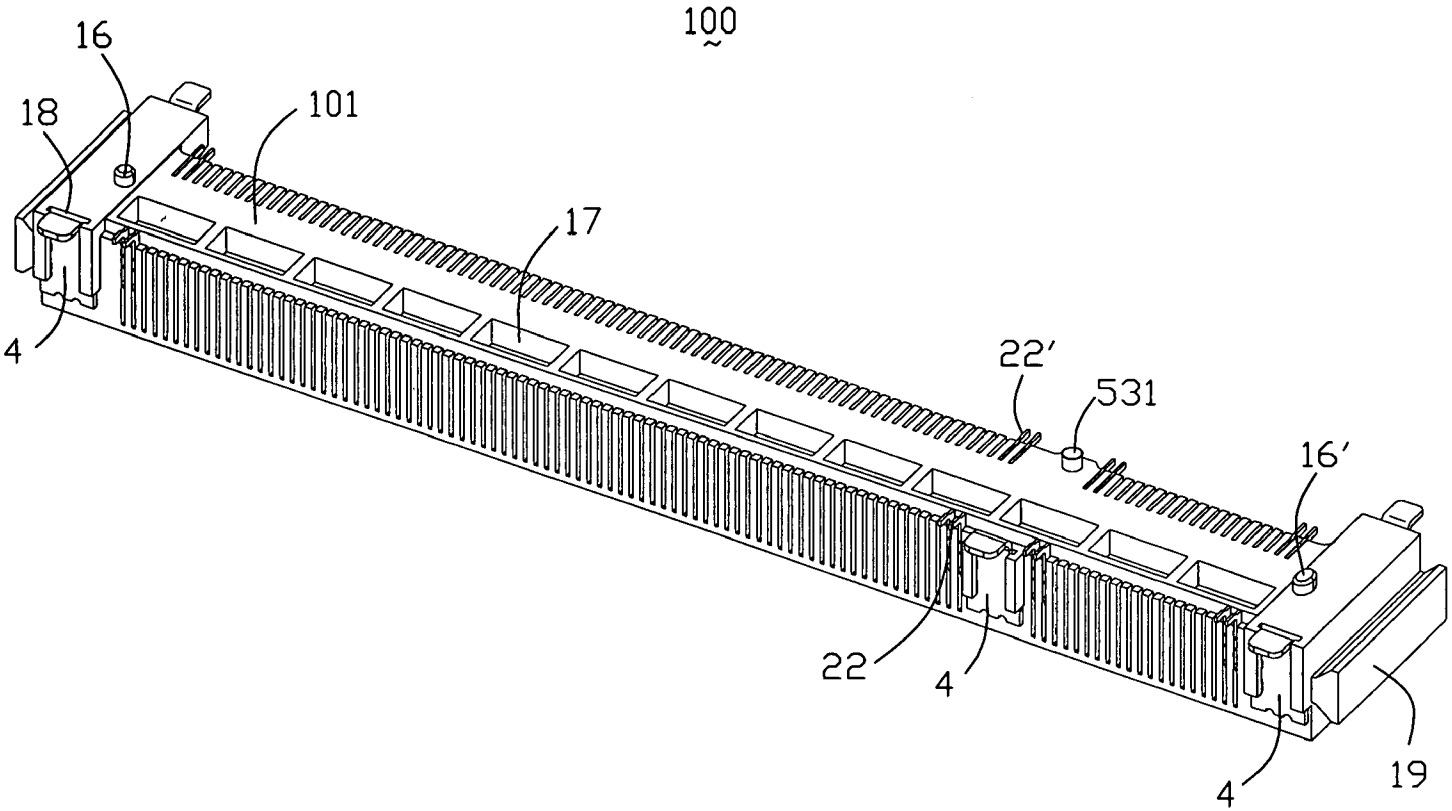
FIG. 2 is a bottom perspective view of the card edge connector of FIG. 1.
Figure 3:
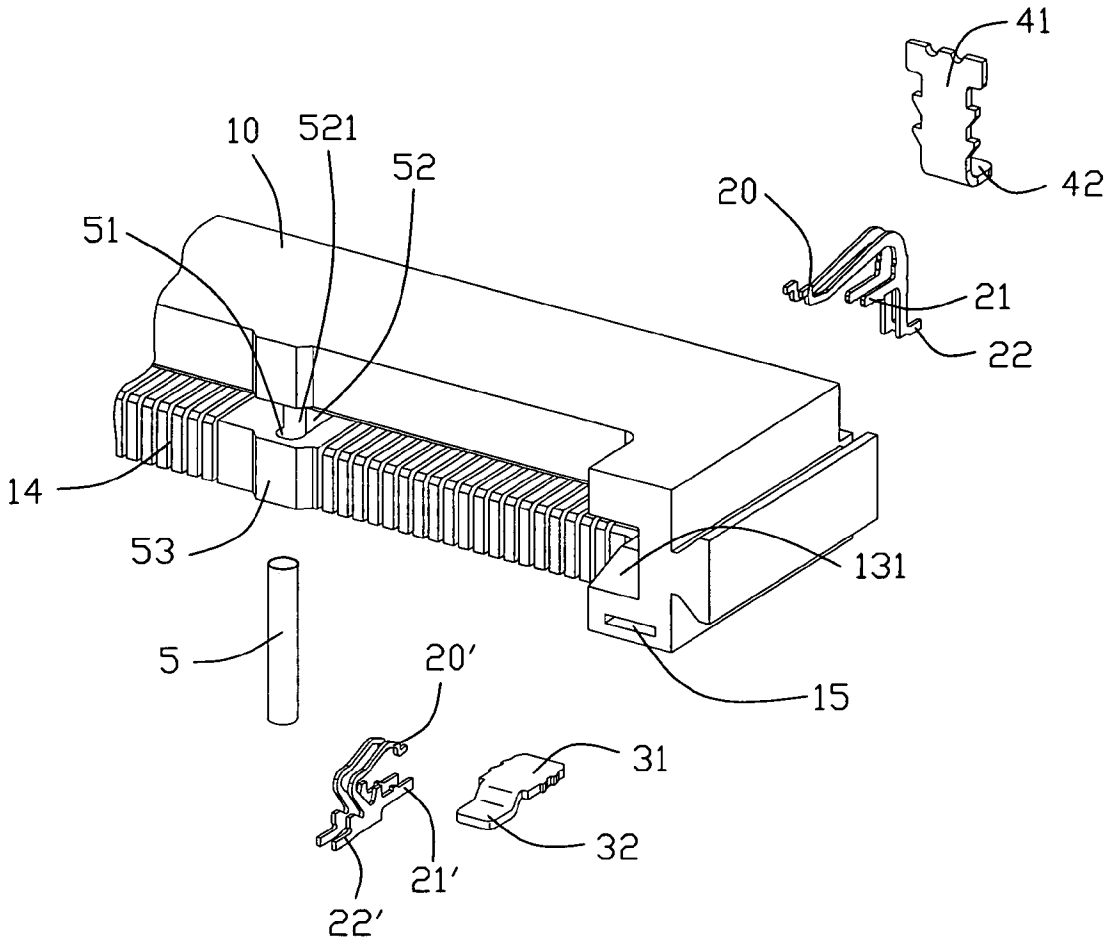
FIG. 3 is an exploded perspective view of a right portion of the card edge connector of FIG. 1.

FIGS. 1-4 shows a card edge connector of the first embodiment. Referring to FIGS. 1 and 3, the card edge connector 100 includes an insulating housing 1. The housing includes an elongated base 10 defining a card-receiving slot 12 along the length thereof and a pair of guiding arms 11 respectively extending forwards from two opposite ends of the base 10. The pair of guiding arms 11 and the base 10 commonly form a card-receiving space therebetween and defines a card-inserting direction. Each guiding arm 11 has a guiding groove 13, which communicates with and is at the same plane with the card-receiving slot 12. The front-end opening 131 of the guiding groove 13 slants upwardly and downwards respectively to form a bugle configuration. Two rows of contact-receiving channels 14 are defined along upper and lower inner walls of the card-receiving slot 12 to receive conductive contacts, each contact comprising a retaining section 21 (21') retained in the housing, a resilient contact section 20 (20') extending into the slot 12 and a leg, i.e. a soldering section 22 (22') extending out the bottom surface of the housing.

The guiding arm 11 defines an opening 15 at its front face adjacent the bottom and a first-metal ear 3 is partially received in the opening. The metal ear 3 includes a retaining portion 31 with tabs retained in the opening 15 and a soldering portion 32, nearer to the bottom than the retaining portion 31, to be soldered on PCB (not shown).

Referring to FIGS. 2 and 3, the soldering sections 22, 22' of the contacts extend out of the bottom face of the housing 1 along opposite direction. The housing includes two positioning post 16, 16' at the bottom thereof, the two posts being of different configuration to prevent the connector 100 from being assembled to the PCB in a wrong direction. And an end 531 of a key 5 positioned at a predetermined place also forms a positioning post, which will be described hereinafter. A row of openings 17 are defined in the bottom, which ensure the bottom face of the housing in a complete plane in molding process. A pair of flanges 19 are defined on two opposite ends of the base 10 to assemble the connector 100 with other electrical connector or other electrical component.

The housing has three retaining channels 18 according to the positioning post 16, 16', 531 on the rearward wall thereof and three second-metal ears 4 is retained in the retaining-channels 18. The metal ear 4 includes a retaining portion 41 with tabs and a soldering portion 42 perpendicularly extending from one end of the retaining portion 41. The retaining portions 41 are inserted into the retaining-channels 18 and then retained in the retaining-channel 18.

Figure 4:
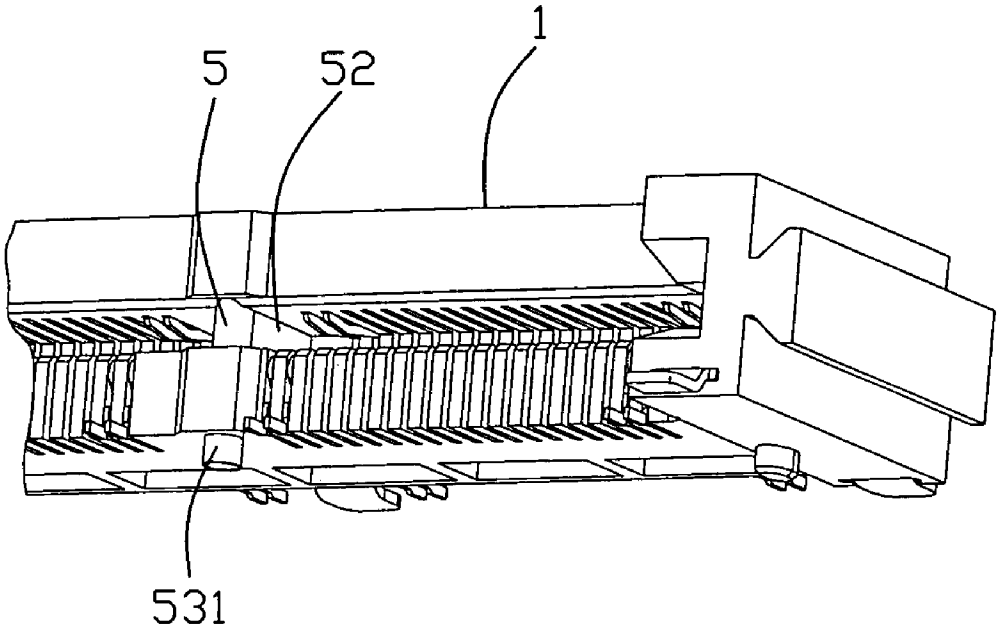
FIG. 4 is a perspective view of the card edge connector shown in FIG. 3.
Figure 5:
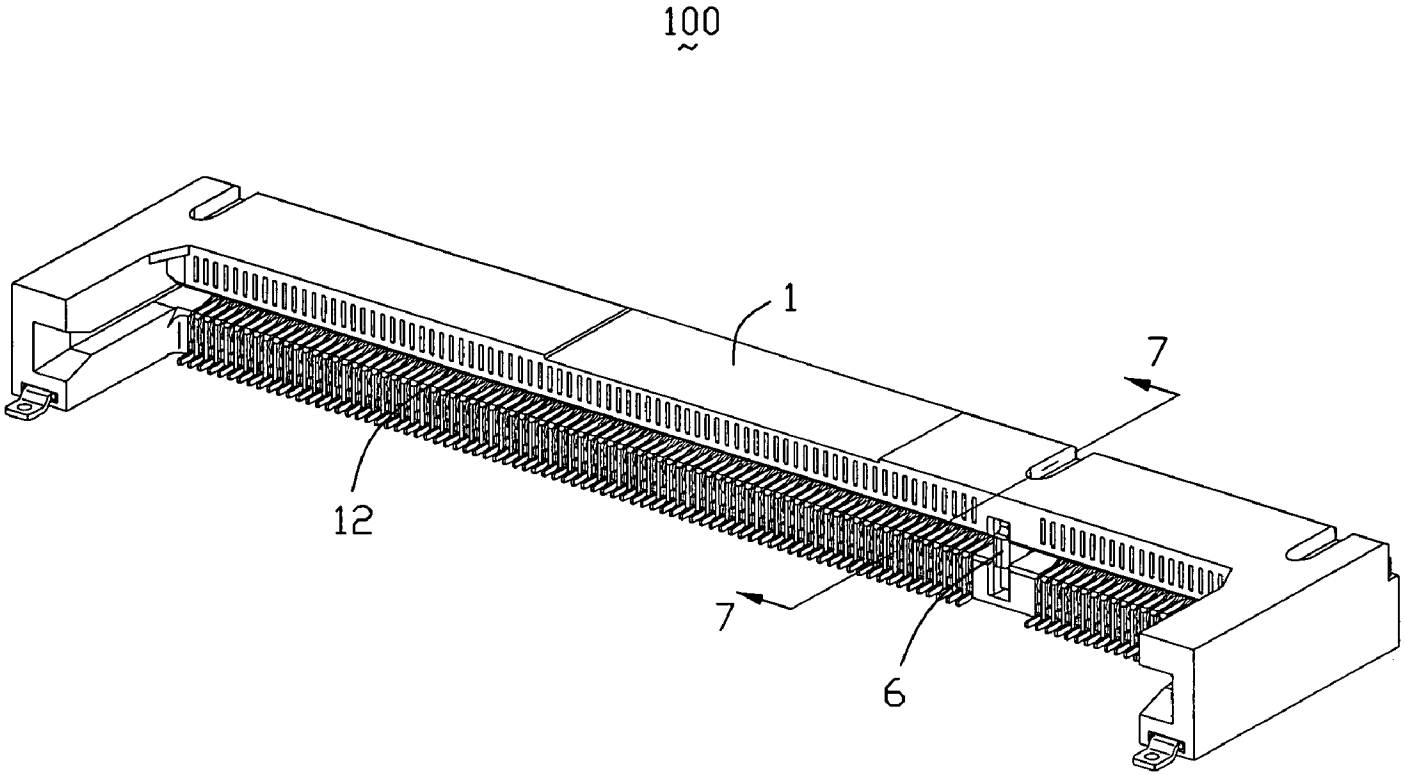
FIG. 5 is a front side perspective view of a card edge connector according to a second embodiment of the present invention.

Referring to FIGS. 1 and 3, there are no contact-receiving channels 14 near to the right guiding arm 11, approximate ⅓ of the base 10, to form a portion P to accord with a notch (not shown) of the daughter card. A retaining hole 51 is defined throughout the upper and lower sidewalls of the slot and adjacent to the front face of the slot 12. A metal column 5 is inserted into the retaining hole 51 from the bottom face, forming said metal key 5 as FIG. 4 shown. A partition 52 is unitarily formed between the upper and lower inner sides of the slot 12 with an arch front portion 521 to accommodate the metal column 5, which will enhance stability of the metal column 5 in the housing. The bottom end 531 of metal column 5 exposes out of the bottom of the housing 1 to form said positioning post. An extending portion 53 is formed in front of the retaining hole 51, which will enlarge area with which the retaining opening positioned.

Diameter of the metal column 5 is larger than the retaining hole 51 to interference with each other. Alternatively, the metal column may be replaced with an elliptic post. The end 531 of the metal post may be flush with the bottom face of the housing to press on the PCB to prevent it from fall off from the retaining hole 51.

Other embodiments will be given hereinafter and similar parts are designated by like reference numbers for simplicity.

FIGS. 5-8 shows a connector of a second embodiment of the present invention. The structure of a card edge connector is similar to the connector 100 of the first embodiment, but with a different key. Now construction of a metal key 6 will be described in detail. A retaining opening 70 is recessed into the slot 12 to receive the metal key 6. The metal key 6 is of a cross shape and includes an elongate base 61, flanges 62, 63 on opposite two edges of the base 61 and a recess 64 on a lower edge of the base 61. The recess 64 is defined with a semicircle shape and throughout the base 61 transversely.

Figure 6:
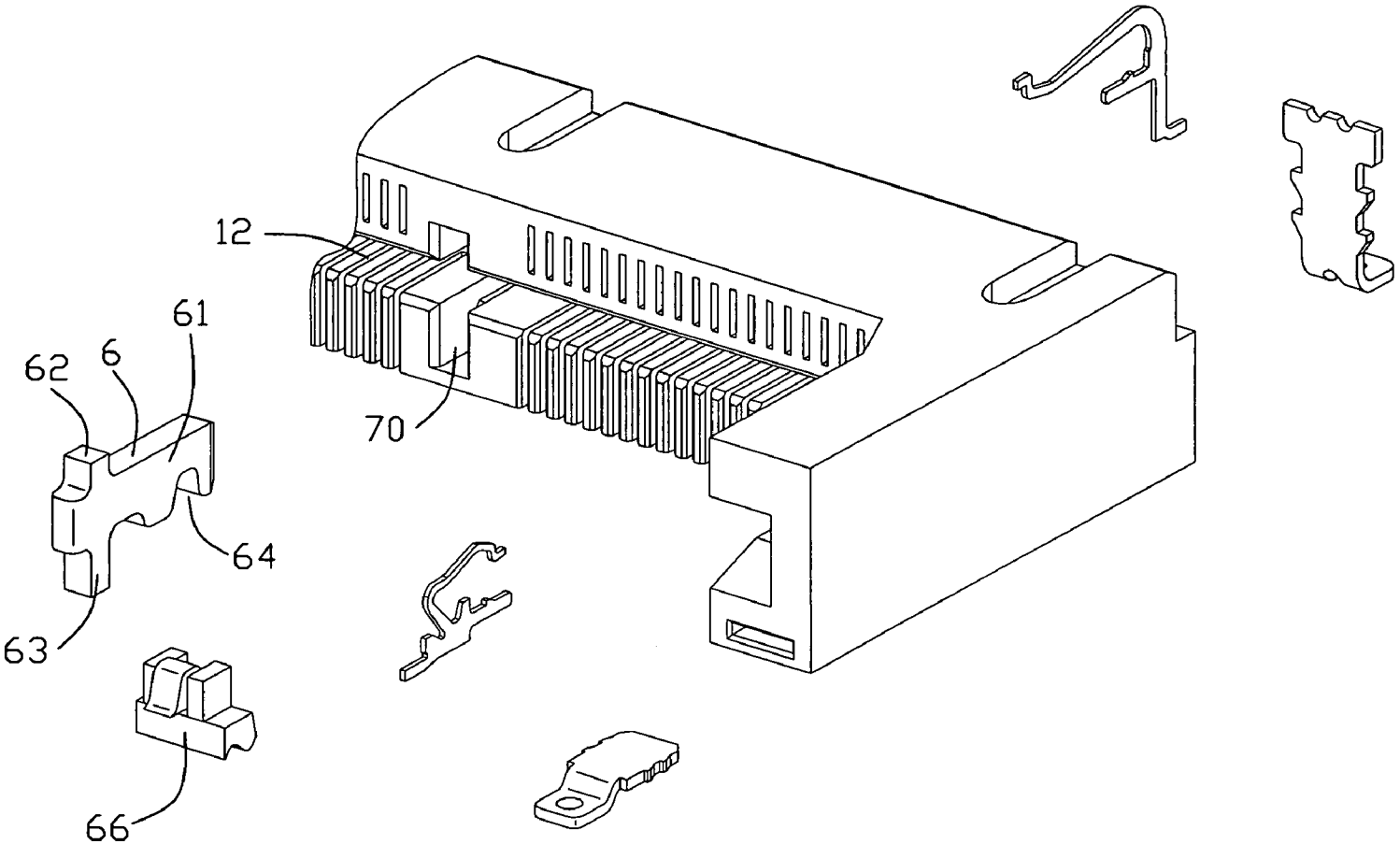
FIG. 6 is an exploded perspective views of a right portion of the card edge connector of FIG. 5.
Figure 7:
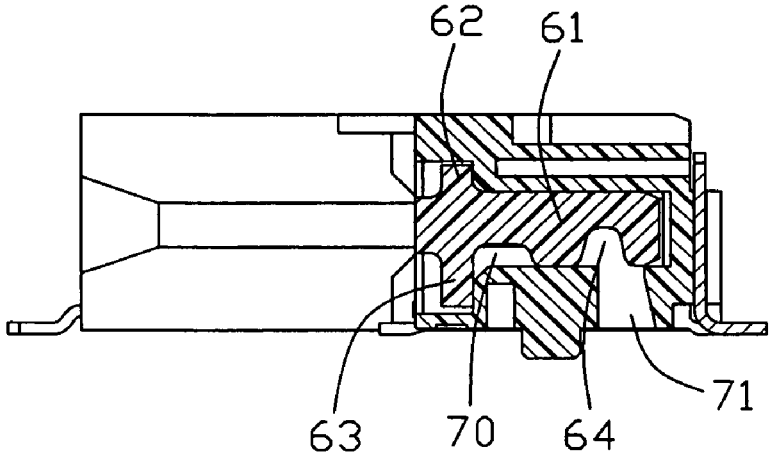
FIG. 7 is a cross-section view of the card edge connector showing in FIG. 6 taken along 7-7, wherein the position member is not inserted into the cavity.
Figure 8:
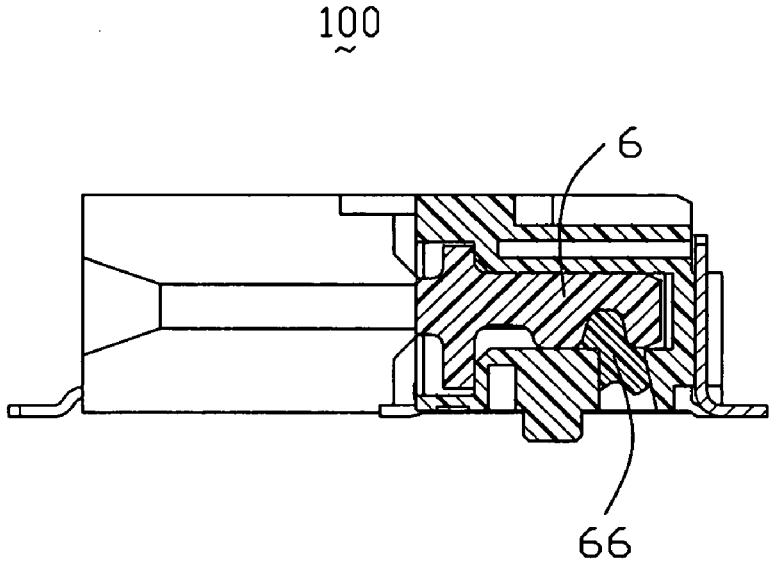
FIG. 8 is a cross-section view of the card edge connector showing in FIG. 6 taken along 7-7, wherein the position member is inserted into the cavity.

Referring to FIGS. 7-8 showing assembly process of the cross metal 6 to the housing, the cross metal 6 is inserted into the retaining opening 70 with the flanges 62, 63 or ribs (not shown) on the base 61 retained in the housing and then mass of stickiness material is injected into a cavity 71 communicating with the retaining opening 70. The material fills with the recess 64 and the cavity 71 and forms a positioning member 66 after the material cooling. The position member 66 is of a configuration as shown in FIG. 6. Alternatively, the recess 64 might be other shape. Therefore the metal key 6 is fitly held in the slot 12, the positioning member 6 can prevent the metal key 6 from pulling out or falling off from the retaining opening 70 along the card-inserting direction.

Figure 9:
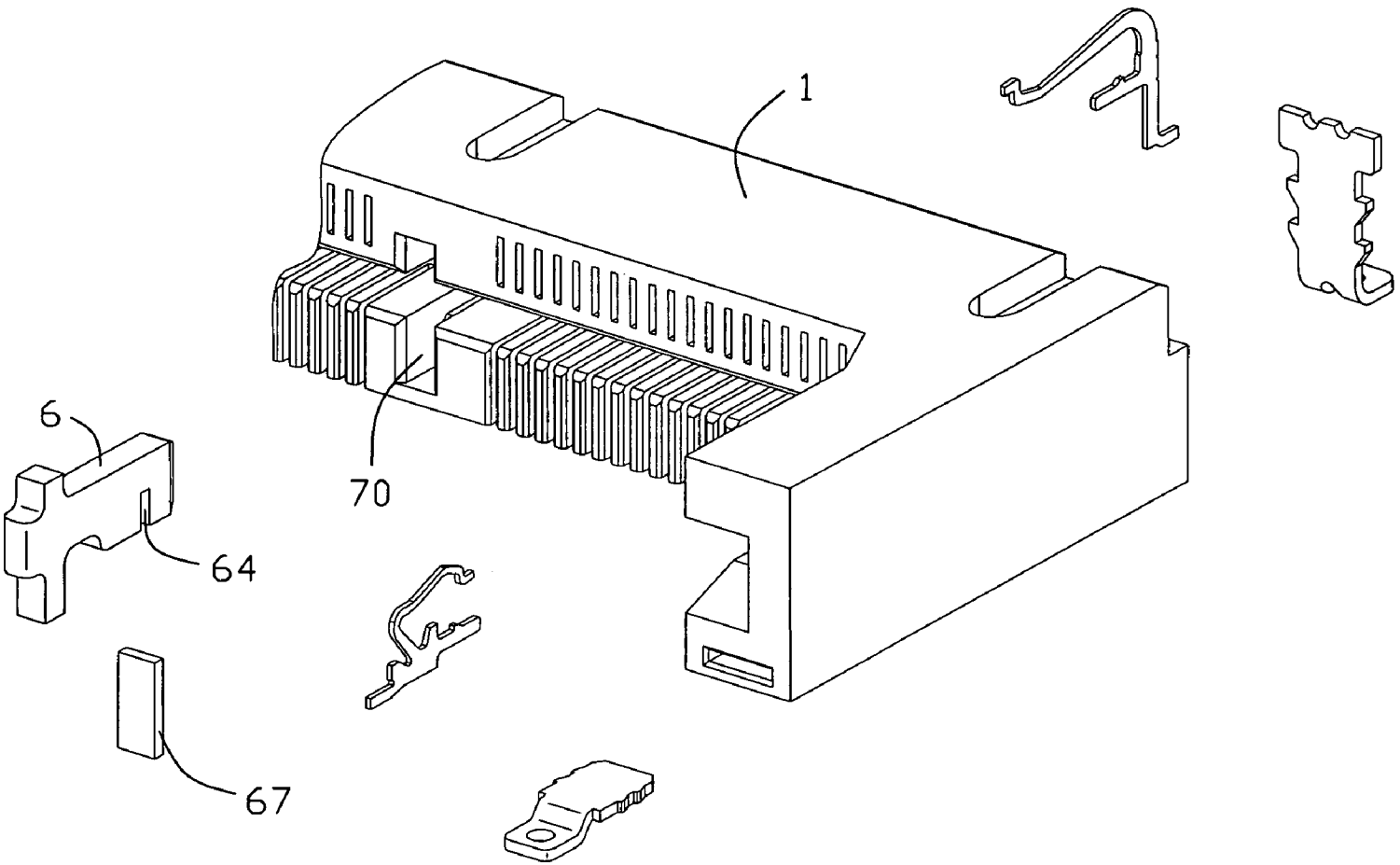
FIG. 9 is an exploded perspective views of a right portion of a card edge connector according to a third embodiment of the present invention.
Figure 10:
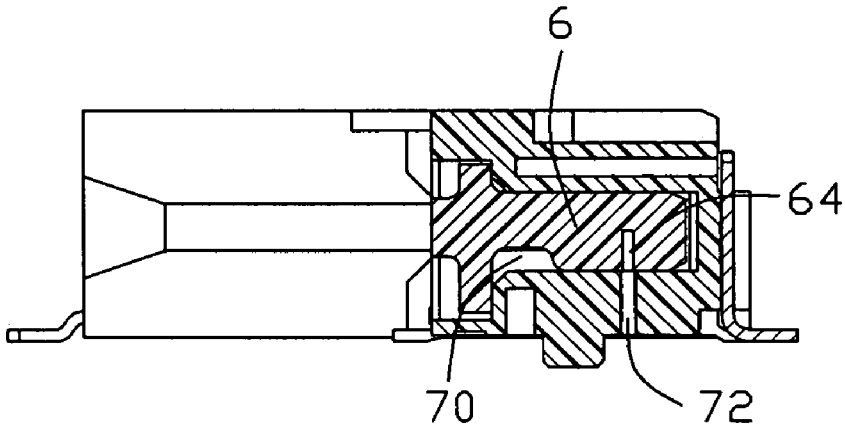
FIG. 10-11 are cross-section views of the card edge connector of the third embodiment, which are similar to FIGS. 7-8, only the configuration of the position member is different.
Figure 11:
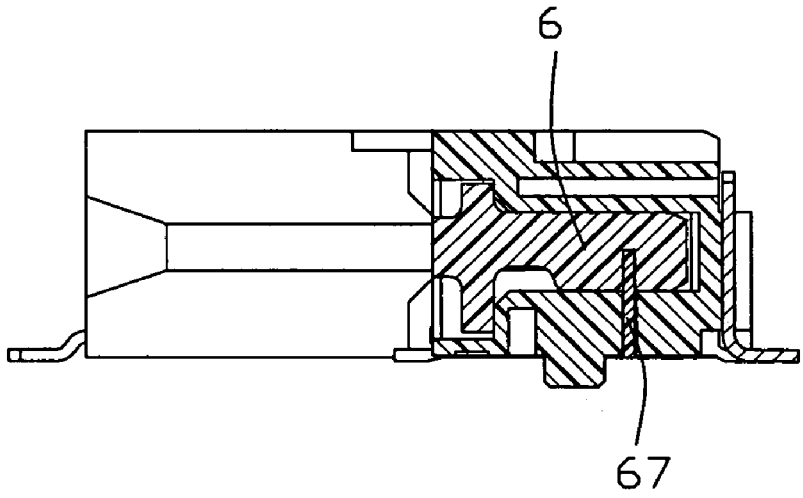

FIGS. 9-11 shows a connector of the third embodiment of the invention. The housing and cross metal 6 of this embodiment are similar to the second embodiment, which will not describe again. The recess 64 is of rectangular shape and the housing has a rectangular cavity 72 communicating with the retaining opening 70. The cross metal 6 is inserted into the retaining opening 70 and a board-shaped member 67 is inserted into the cavity 72 and the recess 64. The board-shaped member 67 is fitly retained in the cavity 74 and the recess 74 to function as a position member similar to the position member 66 in the second embodiment.

Figure 12:
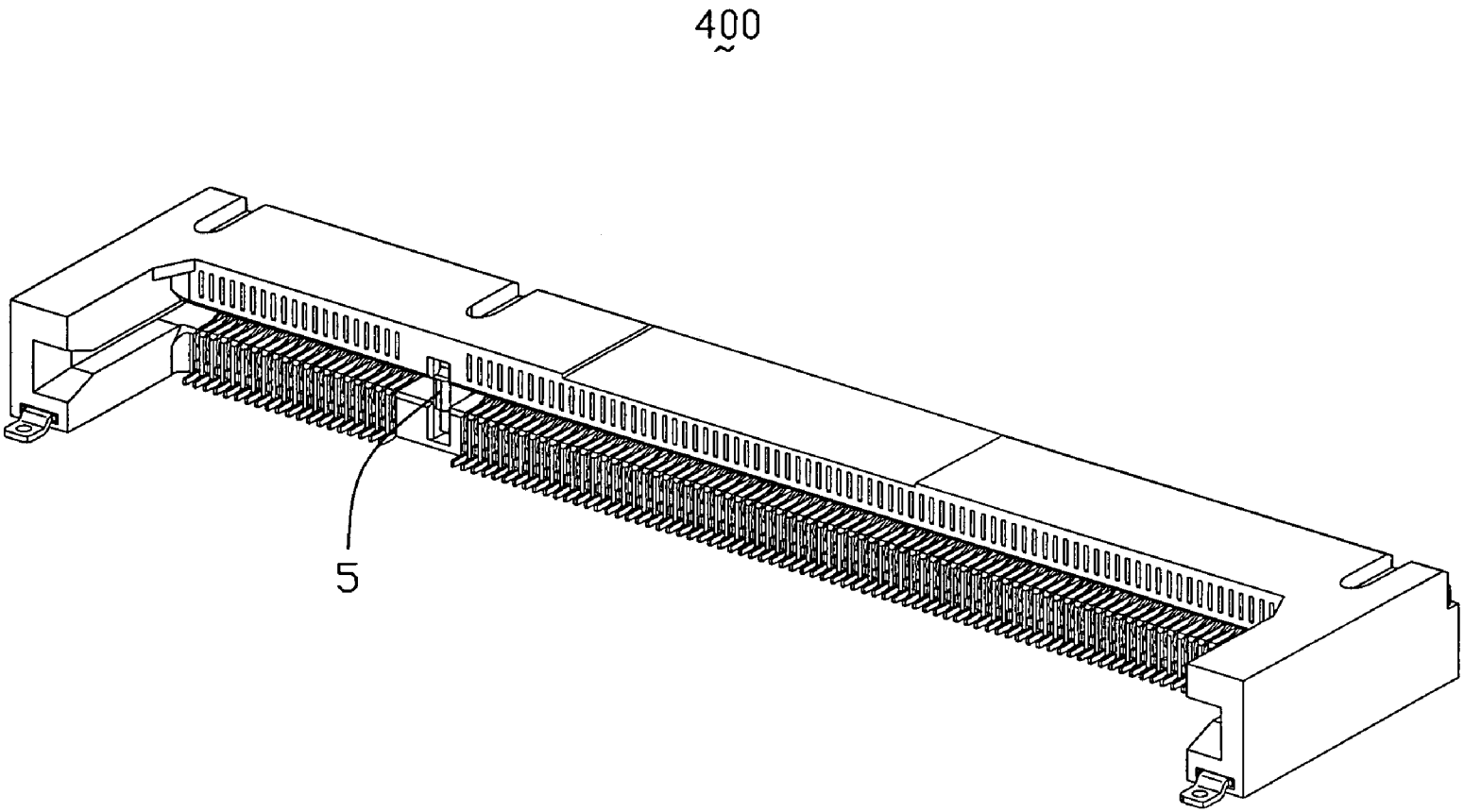
FIG. 12 is a front side perspective view of a card edge connector according to a forth embodiment of the present invention.

FIG. 12 shows a connector of the forth embodiment of the invention. The housing and the metal key of the forth embodiment is similar to the second or the third embodiment, but the metal key is closer to the left of the guiding arm, which is named as a reversed connector generally.

Figure 13:
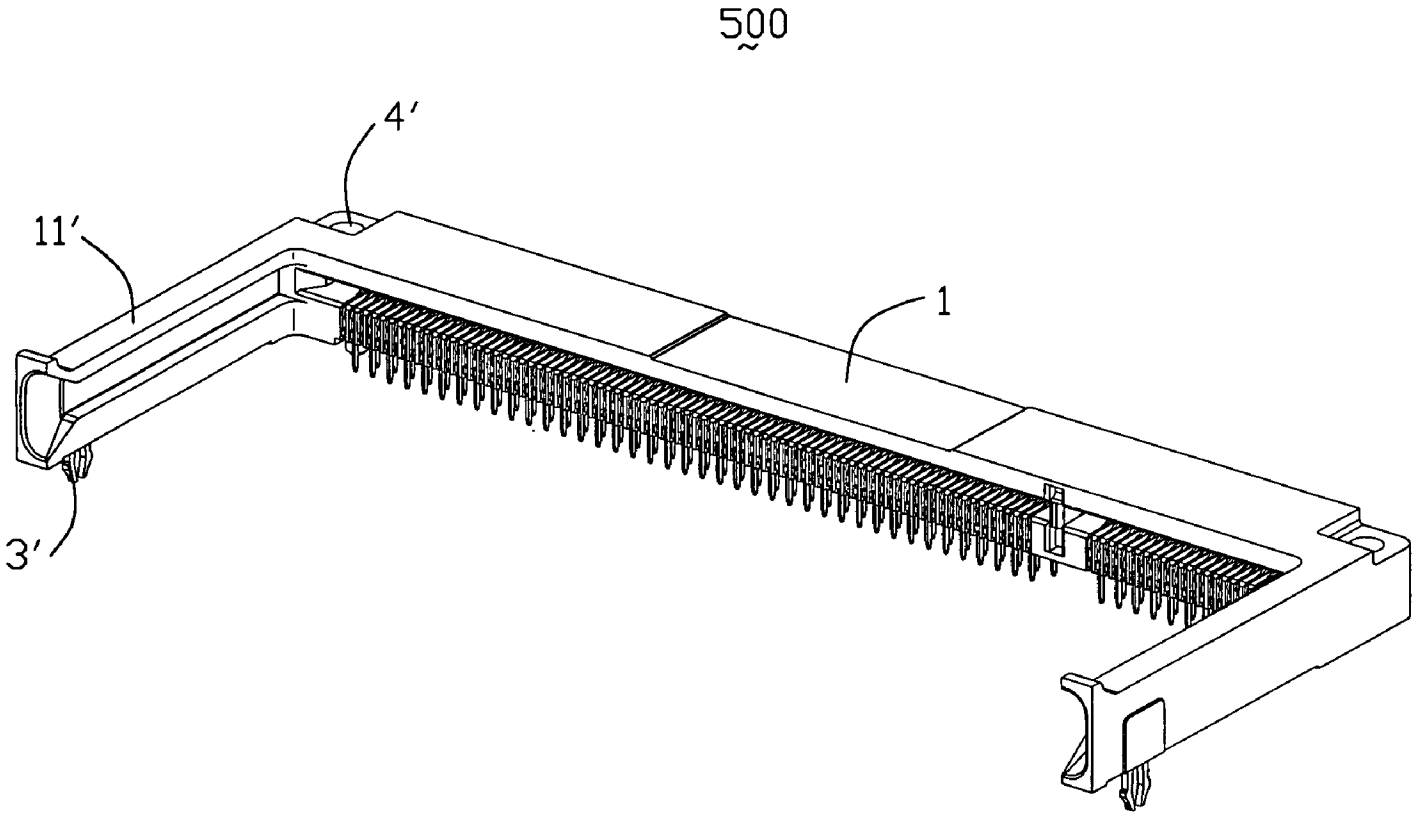
FIG. 13 is a front side perspective view of a card edge connector according to a fifth embodiment of the present invention.

FIG. 13 shows a connector of the fifth embodiment of the invention. The connector of the fifth embodiment defines a pair of guiding arm 11' at opposite ends of the housing, a board lock 3' on the front end of the bottom of the guiding arm 11' and a pair of through-holes 4' on the opposite ends adjacent where the guiding arms 11' extend. The board locks and the through-hole functions as the first and second metal ear 3, 4.

The key of this invention is separately formed from the housing and is capable of preventing from abrasion or breakage, especially the metal key. Therefore, the card can be precisely positioned in the slot of the connector.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card edge connector adapted for a daughter card with at least one notch, comprising:

a housing made from insulating material and comprising a slot for receiving the daughter card along its length direction and contact-receiving channels communicating with the slot;

a plurality of conductive contacts received in the channels, each comprising a contacting section extending into the slot for contacting with the daughter card and a leg extending out of the housing;

at least one key for matching with the at least one notch of the daughter card, transversely retained in the slot; and at least one position member preventing the key from falling off the slot wherein a retaining opening is defined opened along a card-inserting direction and a cavity communicating with the retaining opening and through a sidewall adjacent the slot, said key is inserted into the retaining opening along the card-inserting direction and the position member is filled with the cavity from the sidewall; wherein the key comprises a recess on one edge thereof and a top end of the position member is blocked in the recess to prevent said key from falling off along the card-inserting direction.

2. The card edge connector according to claim 1, wherein said key is made from metal material.

3. The card edge connector according to claim 1, wherein the position member is of a board shape with which the recess and the cavity are filled.

4. The card edge connector according to claim 1, wherein the housing defines a pair of guiding arms perpendicularly extending from two opposite ends thereof, and each guiding arm defines a guiding groove with a same plane of the slot.

5. The card edge connector according to claim 1, wherein the position member is formed by mass of material filled into the cavity.

6. The card edge connector according to claim 5, further comprising first-metal ears retained in the guiding arms and second-metal ears retained in sidewalls opposite to the slot, the first and second metal ear both comprising soldering portions parallel to the bottom of the housing.

7. The card edge connector according to claim 6, wherein the position member is filled with a recess defined on one edge of the key and a cavity defined the housing.

8. An electrical connector comprising:

an insulating housing defining a elongated slot extending longitudinally along a first direction while communicating with an exterior in a second direction perpendicular to the first direction;

at least one row of contacts disposed in the housing and beside said slot;

at least one key inserted into the slot in the second direction;

at least one position member encountering the at least one key in a third direction to prevent the at least one key from falling off in the second direction wherein said key and position member decussate when assembled.

9. The card edge connector according to claim 8, wherein the housing defines a pair of guiding arms at two opposite ends thereof with a guiding groove communicating with and at a same plane with the slot.

10. The card edge connector according to claim 8, wherein the at least one key is metallic block.

11. A card edge connector assembly comprising:

an insulative housing defining a central slot extending along a longitudinal direction of the housing;

a key receiving cavity and a positioning member receiving cavity defined in the housing and communicating with each other;

a key inserted into the key receiving cavity from an exterior in a first direction and transversely interrupting the central slot;

a positioning member inserted into the positioning member receiving cavity from the exterior in a second direction, and locking the key in position; wherein the first direction is different from the second direction.

12. The assembly as claimed in claim 11, wherein the first direction is perpendicular to the second direction.

13. The assembly as claimed in claim 12, wherein both said first direction and said second direction are perpendicular to said longitudinal direction.

14. The assembly as claimed in claim 12, wherein said key is exposed to the exterior while the positioning member is hidden from the exterior once the connector is mounted to a printed circuit board.

* * * * *